US006774568B2

(12) United States Patent
Yang

(10) Patent No.: US 6,774,568 B2
(45) Date of Patent: Aug. 10, 2004

(54) MAGNETRON FOR MICROWAVE OVEN

(75) Inventor: Sung-chol Yang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/447,997

(22) Filed: May 30, 2003

(65) Prior Publication Data

US 2004/0100199 A1 May 27, 2004

(30) Foreign Application Priority Data

Nov. 21, 2002 (KR) ..... 10-2002-0072848

(51) Int. Cl.[7] ..... H01J 25/50

(52) U.S. Cl. ..... 315/39.71; 315/39.51; 315/39.75

(58) Field of Search ..... 315/39.51, 39.53, 315/39.71, 39.75, 85; 219/678

(56) References Cited

U.S. PATENT DOCUMENTS

| | | | | |
|---|---|---|---|---|
| 4,060,750 A | * | 11/1977 | Tashiro et al. | 315/39.51 |
| 4,855,645 A | * | 8/1989 | Kinuno et al. | 315/39.71 |
| 4,900,985 A | * | 2/1990 | Tashiro et al. | 315/39.51 |
| 5,177,403 A | * | 1/1993 | Kawaguchi et al. | 315/39.71 |
| 5,432,405 A | * | 7/1995 | Ochiai et al. | 315/39.51 |
| 5,835,342 A | | 11/1998 | Hunte | 361/681 |
| 5,894,199 A | | 4/1999 | Pasco | 315/39.55 |
| 6,018,847 A | | 2/2000 | Lu | 16/337 |
| 6,031,714 A | | 2/2000 | Ma | 361/681 |

FOREIGN PATENT DOCUMENTS

| | | |
|---|---|---|
| JP | 56-65463 | 6/1981 |
| JP | 1-176630 | 7/1989 |
| JP | 1-183032 | 7/1989 |
| JP | 6-223727 | 8/1994 |
| JP | 6-223729 | 8/1994 |
| JP | 11-96929 | 4/1999 |
| JP | 2001-60440 | 3/2001 |
| KR | 1998-023771 | 7/1998 |
| KR | 20-0145045 | 2/1999 |
| KR | 1999-0030784 | 7/1999 |
| KR | 10-0269478 | 7/2000 |

* cited by examiner

*Primary Examiner*—Haissa Philogene
(74) *Attorney, Agent, or Firm*—Staas & Halsey LLP

(57) ABSTRACT

A magnetron for a microwave oven includes a yoke, an anode cylindrical body installed inside the yoke, a plurality of veins mounted inside the anode cylindrical body, a filament installed in a center of the veins, and an upper magnet and a lower magnet respectively mounted on an upper side and a lower side of the anode cylindrical body. The magnetron also includes an upper pole piece and a lower pole piece respectively installed between the anode cylindrical body and the upper and lower magnets. A length (L) from an external tip of a central part of the upper pole piece to an internal tip thereof, on which a hollow part is formed, is adjusted to suppress harmonics in the magnetron. Thus, generation of the harmonics may be effectively attenuated, and an output of a microwave may be enhanced by preventing power consumption of the magnetron which may be large due to interrupting harmonics.

11 Claims, 4 Drawing Sheets

MAGNETRON FOR MICROWAVE OVEN

CROSS REFERENCE TO RELATED APPLICATION

This application claims the benefit of Korean Application No. 2002-72848, filed Nov. 21, 2002, in the Korean Intellectual Property Office, the disclosure of which is incorporated herein by reference.

BACKGROUND OF THE INVENTION

1. Field of the Invention

The present invention relates to a magnetron for a microwave oven, and more particularly, to a magnetron for a microwave oven in which a generation of harmonics is attenuated by changing a structure of a pole piece of the magnetron.

2. Description of the Related Art

A magnetron used as a heating source in a microwave oven, generates a microwave having a constant frequency (i.e., a fundamental wave), and at the same time, generates harmonics having a frequency of n times (wherein n is an integer) of the fundamental wave through both poles of a magnet. With regard to various ingredients of the harmonics, it has been discovered scientifically that the harmonics in a specific frequency band have caused difficulty in wireless communication and have also caused damages to the human body even though its amount is slight. With the above problems taken into consideration, the amount of the harmonics has legally been limited. Further, following the recent trend of satellite broadcasting, there has been an increase in demand to minimize the harmonics, thereby preventing interferences against the satellite broadcasting.

Conventionally, a method of suppressing generation of the harmonics while the magnetron is in operation has been employed with the use of a choke having an output structure in which the choke is mounted on the magnetron. However, the method has not been effective in attenuating the harmonics at an entire bandwidth. In addition, in order to mount the output structure to attenuate the harmonics at the entire bandwidth, the output structure has to be enlarged and becomes complicated. In this regard, the method has some limitations which have become impractical to apply.

SUMMARY OF THE INVENTION

Accordingly, it is an aspect of the present invention to provide a magnetron for a microwave oven to effectively attenuate harmonics generated by the magnetron.

Additional aspects and advantages of the invention will be set forth in part in the description which follows and, in part, will be obvious form the description, or may be learned by practice of the invention.

The foregoing and or other aspects of the present invention are achieved by providing a magnetron for a microwave oven including a yoke, an anode cylindrical body installed inside the yoke, veins mounted inside the anode cylindrical body, a filament installed in a center of the veins, and an upper magnet and a lower magnet respectively mounted on an upper side and a lower side of the anode cylindrical body. The magnetron also includes an upper pole piece and a lower pole piece respectively installed between the anode cylindrical body and the upper and lower magnets. A length from an external tip of a central part of the upper pole piece to an internal tip thereof, on which a hollow part is formed, is adjusted to suppress harmonics.

According to an aspect of the invention, the length is approximately in a range of 2.0 to 5.5 mm.

BRIEF DESCRIPTION OF THE DRAWINGS

The above and or other aspects and advantages of the present invention will become apparent and more readily appreciated from the following description of the embodiments, taken in conjunction with the accompany drawings of which.

DETAILED DESCRIPTION OF THE PREFERRED EMBODIMENTS

Figure 1:
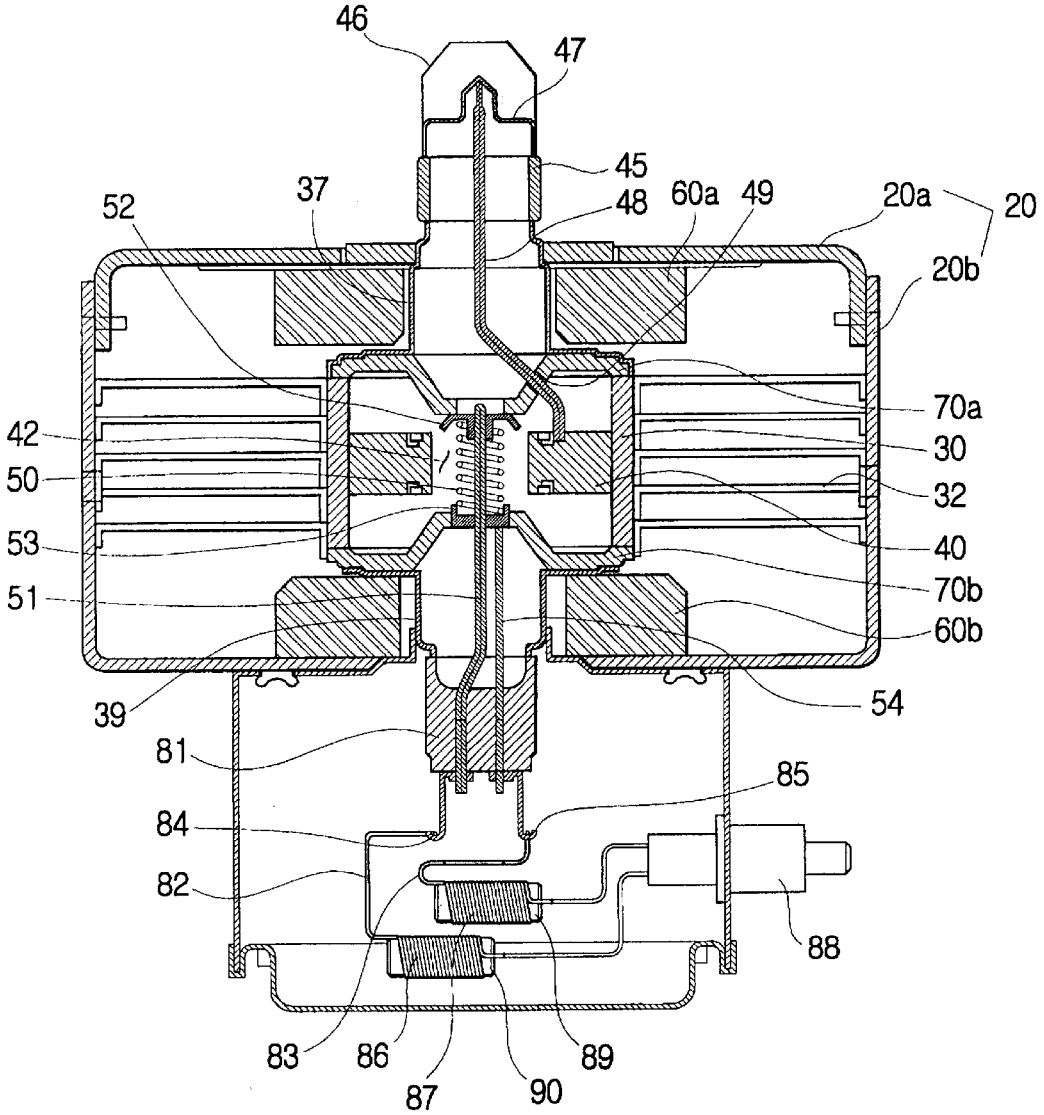
FIG. 1 is a longitudinal sectional view of a magnetron for a microwave oven, according to an embodiment of the present invention.

Reference will now be made in detail to the embodiments of the present invention, examples of which are illustrated in the accompanying drawings, wherein like reference numerals refer to like elements throughout.

FIG. 1 is a longitudinal sectional view of a magnetron for a microwave oven, according to an embodiment of the present invention. As shown in FIG. 1, the magnetron for the microwave oven includes a yoke 20, an anode cylindrical body 30 installed inside the yoke 20, a plurality of veins 40 installed inside the anode cylindrical body 30, a filament 50 installed in a middle of the veins 40, and an upper magnet 60*a* and a lower magnet 60*b* respectively mounted on an upper side and a lower side of the anode cylindrical body 30. The magnetron also includes an upper pole piece 70*a* and a lower pole piece 70*b* installed between the anode cylindrical body 30 and the upper and lower magnets 60*a* and 60*b* to allow central parts 74 in which a hollow part 73 is formed to be opposite to each other.

The anode cylindrical body 30 is made of a copper pipe and is shaped like a cylinder. Inside the anode cylindrical body 30 are disposed the veins 40 to form a resonance cavity in an axial direction, to allow a microwave to be generated. The anode cylindrical body 30 and the veins 40 constitute an anode part. Outside the anode cylindrical body 30 are installed an upper yoke 20*a* and a lower yoke 20*b* to connect magnetic fluxes returned from the upper and lower magnets 60*a* and 60*b*. Between the anode cylindrical body 30 and the lower yoke 20*b* are installed a plurality of aluminum cooling fins 32.

In a center of the anode cylindrical body 30 is formed a small space 42. Within the small space 42 is disposed a filament 50 coaxially with the anode cylindrical body 30. The filament 50 is made by sintering a mixture of tungsten and thoria, and is wound spirally to make the small space 42 generate a high temperature.

To opposite ends of the filament 50 are respectively coupled an upper shield hat 52 and a lower shield hat 53 to prevent a thermal electron which generates an electric current loss and makes no contribution to an oscillation of microwaves, from being radiated toward a central direction of the magnetron. A first filament electrode 51 as a central supporter is welded on a central through hole of the lower shield hat 53 to be extended downward as it passes through the central through hole. A second filament electrode 54 is welded on a bottom face of the lower shield hat 53 and extended downward in parallel with the first filament electrode 51.

The first and the second filament electrodes 51 and 54 are electrically connected to a first external connection terminal 84 and a second external connection terminal 85, respectively, which pass through an insulating ceramics 81 to fixedly support a cathode of the magnetron, and are connected to power terminals 82 and 83, thereby supplying the electric current generated by the thermal electron to the filament 50. The power terminals 82 and 83 are electrically connected to choke coils 86 and 87, respectively. The choke coils 86 and 87 are connected to a capacitor 88 provided in a side wall of a box filter. Inside the choke coils 86 and 87 are respectively inserted ferrites 89 and 90 to absorb noise.

The upper pole piece 70*a* and lower pole piece 70*b* is also provided to form a magnetic path to uniformly guide the magnetic fluxes generated in the upper and the lower magnets 60*a* and 60*b* within the small space 42 between the filament 50 and the veins 40. An upper shield cup 37 and a lower shield cup 39 are closely welded on a top of the upper pole piece 70*a* and a bottom of the lower pole piece 70*b*, respectively.

Antenna ceramics 45 and the insulating ceramics 81 are closely coupled to the upper and the lower shield cups 37 and 39, respectively, to thereby close an inside of the anode cylindrical body 30 in a vacuum. On external sides of the upper and lower shield cups 37 and 39 are disposed the upper and lower magnets 60*a* and 60*b*, allowing the upper and lower shields cup 37 and 39 to take a shape of a ring and maintain a distribution of a magnetic field constantly within the anode cylindrical body 30.

To an upper leading edge of the antenna ceramics 45 is coupled an exhausting pipe 47 made of copper. On an inside central part of the exhausting pipe 47 is fixed a tip of an antenna 48 passing through a through hole 49 of the upper pole piece 70*a* and being extended upward from the veins 40 to allow a microwave oscillated within the resonance cavity to be outputted. On an external side of the exhausting pipe 47 is provided an antenna cap 46 to protect a coupling part of the exhausting pipe 47 and the antenna ceramics 45, and at the same time, to prevent a spark due to concentration of an electronic field. The antenna cap 46 also functions as a window through which the microwave is allowed to be outputted to the outside.

Figure 2:
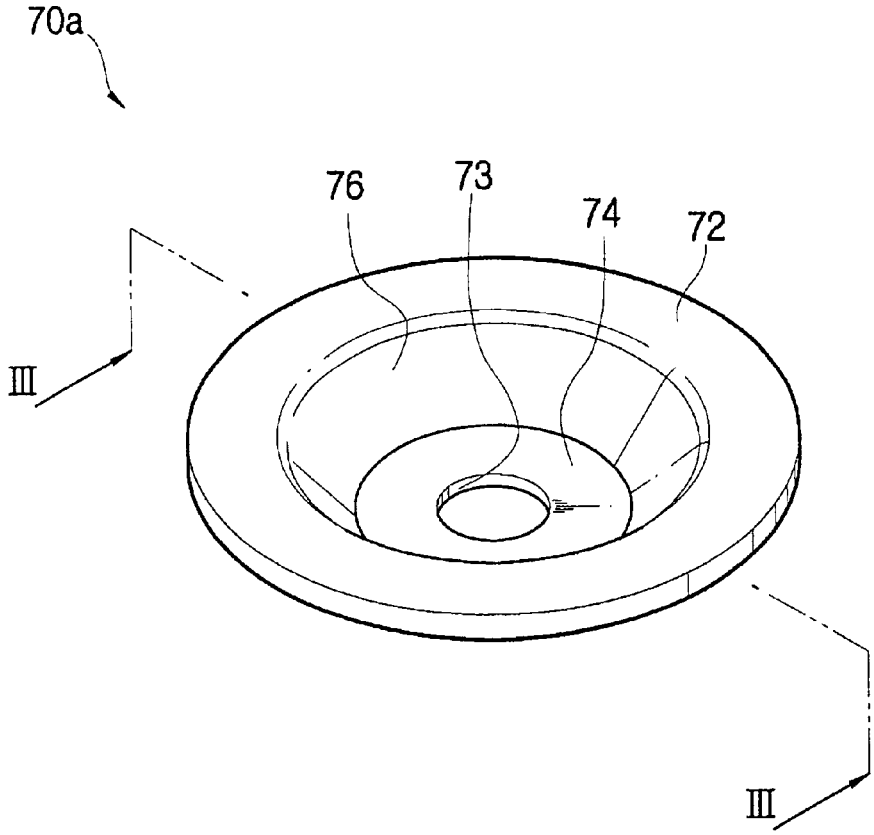
FIG. 2 is a perspective view showing a structure of an upper pole piece of the magnetron for the microwave oven shown in FIG. 1.
Figure 3:
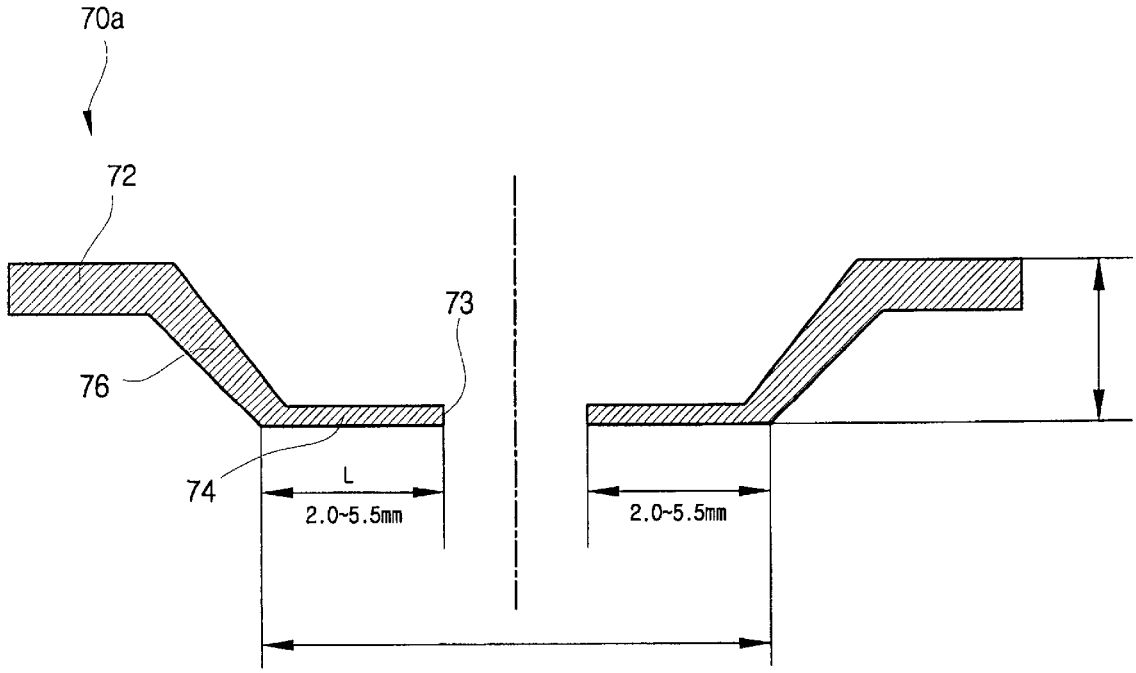
FIG. 3 is a sectional view of FIG. 2 taken along line III—III.
Figure 4:
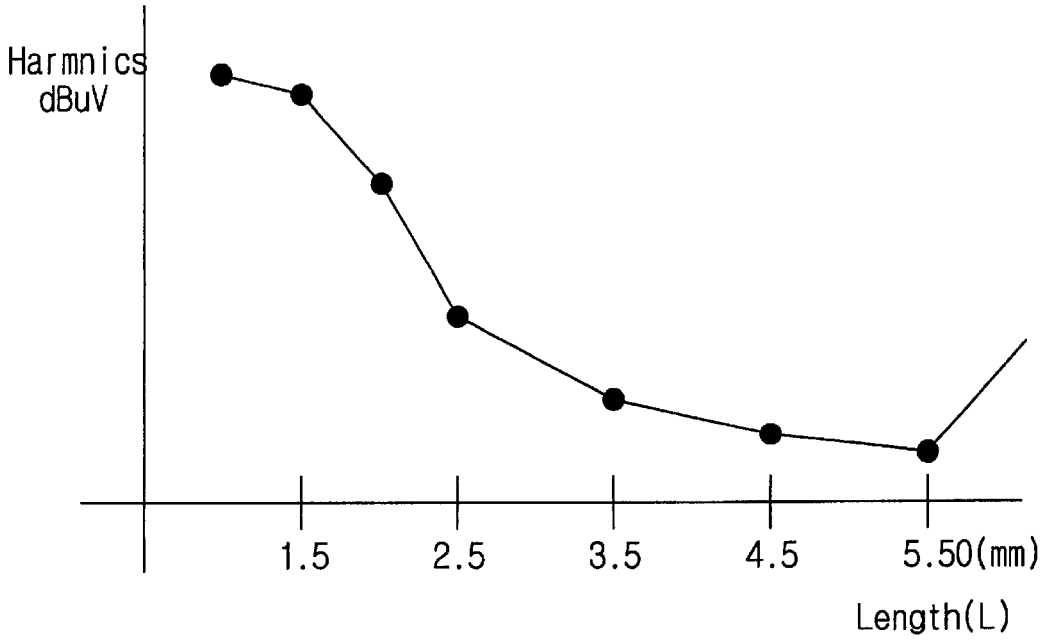
FIG. 4 is a graph showing a fluctuation of harmonics relative to a length (L) of a central part of an upper pole piece of the magnetron for the microwave oven shown in FIG. 1.

FIG. 2 is a perspective view showing a structure of the upper pole piece 70*a* of the magnetron for the microwave oven shown in FIG. 1. FIG. 3 is a sectional view of FIG. 2 taken along line III—III. FIG. 4 is a graph showing a fluctuation of the harmonics according to a length (L) of the central part of the upper pole piece 70*a* of the magnetron for the microwave oven shown in FIG. 1.

As shown in the above figures, the upper pole piece 70*a* includes a horizontal flange part 72, an inclined part 76 curved and extended inwardly from the flange part 72, and a central part 74 curved and extended inwardly from the inclined part 76 on a center of which the hollow part 73 is formed.

The upper pole piece 70*a* is almost symmetrical in structure to the lower pole piece 70*b* as shown in FIG. 1. The harmonics may be attenuated by adjusting a length from an external tip of the central part 74 of the upper pole piece 70*a* to an internal tip thereof, on which the hollow part 73 is formed.

As a result of measuring an amount of harmonics generated, relative to the length (L) from the external tip of the central part 74 of the upper and lower pole pieces 70*a* and 70*b* to the internal tip thereof, on which the hollow part 73 is formed with a harmonics measuring device, it is discovered that the lower pole piece 70*b* does not nearly affect the attenuation of the harmonics. However, when adjusting the length of the upper pole piece 70*a*, the generated amount of the harmonics has clearly been changed depending upon the length (L) thereof as demonstrated in FIG. 4. Particularly, where the length (L) is approximately in a range of 2.0 to 5.5 mm, the generated amount of the harmonics is remarkably attenuated.

An operation of the magnetron for the microwave oven as described above will be described herein below.

If electric power is supplied through the first and second external connection terminals 84 and 85, a current to drive the filament 50 is applied, and thermal electrons are discharged within the small space 42 from the filament 50 when the filament 50 is heated to a high temperature by the driving current. Here, a strong electric field is formed within the small space 42 between the filament 50 and the veins 40 by a driving voltage applied to the second filament 54 and the anode part. The electric field thereby reaches the filament 50 from the veins 40.

The magnetic fluxes generated from the upper and lower magnets 60*a* and 60*b* are guided toward the small space 42 along the lower pole piece 70*b*. The guided magnetic fluxes go toward the upper pole piece 70*a* through the small space 42 and are distributed within a magnetic circuit formed by the upper yoke 20*a*, the lower yoke 20*b*, the upper pole piece 70*a*, the lower pole piece 70*a* and the small space 42, thereby forming a high density of magnetic fluxes within the small space 42.

Therefore, the thermal electrons discharged to the small space 42 from a surface of the filament 50 at a high temperature go toward the veins 40 or the anode cylindrical body 30 by the strong electric field existing within the small space 42, and at the same time, move in a circular motion by a force received vertically relative to an ongoing direction of the strong magnetic flux density existing within the small space 42.

The motion of the thermal electrons is made within the entire small space 42. The thermal electrons form a group of electrons in the structural resonance cavity and repetitively perform the ongoing movement toward to the veins 40 having a high potential. Accordingly, a microwave as predetermined corresponding to a rotation speed of the group of electrons is outputted via the veins 40.

As described above, according to the present invention, generation of the harmonics may be effectively attenuated by adjusting a dimension of the central part of the upper pole piece, and the output of a microwave may be enhanced by preventing power consumption of the magnetron which may be large due to interrupting harmonics.

In addition, the present invention is relatively simple in structure compared with the conventional structure using a conventional choke, and thereby reduces production costs.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A magnetron for a microwave oven, comprising:

a yoke;

an anode cylindrical body installed inside the yoke;

veins mounted inside the anode cylindrical body;

a filament installed in a center of the veins;

an upper magnet and a lower magnet respectively mounted on an upper side and a lower side of the anode cylindrical body; and an upper pole piece and a lower pole piece respectively installed between the anode cylindrical body and the upper and lower magnets, wherein a length from an external tip of a central part of the upper pole piece to an internal tip thereof, on which a hollow part is formed, is adjusted to suppress harmonics.

2. The magnetron according to claim 1, wherein the length (L) is approximately in a range of 2.0 to 5.5 mm.

3. The magnetron according to claim 1, wherein the upper pole piece comprises:

a horizontal flange part; and an inclined part curved and extended inwardly from the horizontal flange part, wherein the central part is curved and extended inwardly from the inclined part on a center of which the hollow part is formed.

4. The magnetron according to claim 1, wherein the upper pole piece is configured approximately symmetrical to the lower pole piece.

5. The magnetron according to claim 1, wherein the upper pole piece and the lower pole piece are provided to form a magnetic path to uniformly guide a magnetic flux generated in the upper and lower magnets within a small space between the filament and the veins.

6. The magnetron according to claim 5, further comprising:

an upper shield cup and a lower shield cup closely welded on a top of the upper pole piece and a bottom of the lower pole piece, respectively; and antenna ceramics and insulating ceramics closely coupled to the upper and lower shield cups, respectively, to close an inside of the anode cylindrical body in a vacuum.

7. The magnetron according to claim 6, wherein the upper and lower magnets are disposed on external sides of the upper and lower shield cups, allowing the upper and low shield cups to form a ring-like shape and maintain a distribution of a magnetic field constantly within the anode cylindrical body.

8. The magnetron according to claim 6, further comprising:

an antenna extended upward from the veins to pass through a through hole of the upper pole piece, allowing a microwave to be outputted.

9. The magnetron according to claim 8, further comprising:

an exhausting pipe fixed to a tip of the antenna and coupled to an upper leading edge of the antenna ceramics; and an antenna cap provided on an external side of the exhausting pipe to protect a coupling part of the exhausting pipe and the antenna ceramics, and to prevent a spark due to concentration of an electronic field in the magnetron.

10. A method of attenuating harmonics in a magnetron for a microwave oven, comprising:

installing, respectively, an upper pole piece and a lower pole piece between an anode cylindrical body and upper and lower magnets of the magnetron;

adjusting a length from an external tip of a central part of the upper pole piece to an internal tip thereof, on which a hollow part is formed, to suppress the harmonics generated by the magnetron.

11. The method according to claim 10, wherein the length is approximately in a range of 2.0 to 5.5 mm.

* * * * *

UNITED STATES PATENT AND TRADEMARK OFFICE

CERTIFICATE OF CORRECTION

PATENT NO. : 6,774,568 B2
APPLICATION NO. : 10/447997
DATED : August 10, 2004
INVENTOR(S) : Yang It is certified that error appears in the above-identified patent and that said Letters Patent is hereby corrected as shown below:

On the Title Page Item [57] (ABSTRACT), Line 3, Delete "veins" and insert -- vanes --, therefor.
On the Title Page Item [57] (ABSTRACT), Line 4, Delete "veins," and insert -- vanes, --, therefor.

In the Specification

In Column 1, Line 58, Delete "veins" and insert -- vanes --, therefor.
In Column 1, Line 59, Delete "veins," and insert -- vanes, --, therefor.
In Column 2, Line 35, Delete "veins" and insert -- vanes --, therefor.
In Column 2, Line 37, Delete "veins" and insert -- vanes --, therefor.
In Column 2, Line 47, Delete "veins" and insert -- vanes --, therefor.
In Column 2, Line 49, Delete "veins" and insert -- vanes --, therefor.
In Column 3, Line 23, Delete "veins" and insert -- vanes --, therefor.
In Column 3, Line 40, Delete "veins" and insert -- vanes --, therefor.
In Column 4, Line 22, Delete "veins" and insert -- vanes --, therefor.
In Column 4, Line 25, Delete "veins" and insert -- vanes --, therefor.
In Column 4, Line 37, Delete "veins" and insert -- vanes --, therefor.
In Column 4, Line 46, Delete "veins" and insert -- vanes --, therefor.
In Column 4, Line 49, Delete "veins" and insert -- vanes --, therefor.

In the Claims

Claim 1, in Column 5, Line 5, Delete "veins" and insert -- vanes --, therefor.
Claim 1, in Column 5, Line 6, Delete "veins;" and insert -- vanes; --, therefor.
Claim 5, in Column 5, Line 32, Delete "veins." and insert -- vanes. --, therefor.
Claim 8, in Column 6, Line 13, Delete "veins" and insert -- vanes --, therefor.

Signed and Sealed this
Twentieth Day of May, 2014

Michelle K. Lee

Michelle K. Lee
*Deputy Director of the United States Patent and Trademark Office*